US006723028B1

(12) United States Patent
Wang et al.

(10) Patent No.: US 6,723,028 B1
(45) Date of Patent: Apr. 20, 2004

(54) ROCKER ARM OF A TREADMILL

(76) Inventors: Leao Wang, No.1, Lane 233, Sec.2, Charng Long Rd., Taiping (TW), 411; Peter Wu, No.1, Lane 233, Sec.2, Charng Long Rd., Taiping (TW), 411

( * ) Notice: Subject to any disclaimer, the term of this patent is extended or adjusted under 35 U.S.C. 154(b) by 0 days.

(21) Appl. No.: 10/300,961

(22) Filed: Nov. 22, 2002

(51) Int. Cl.[7] ..... A63B 22/02
(52) U.S. Cl. ..... 482/54
(58) Field of Search ..... 482/54, 70, 71, 482/51, 62, 72, 73, 57, 138, 139

(56) References Cited

U.S. PATENT DOCUMENTS 5,110,117 A * 5/1992 Fisher et al. ..... 482/54
5,707,319 A * 1/1998 Riley ..... 482/54
6,544,147 B1 * 4/2003 Wang et al. ..... 482/54

* cited by examiner

*Primary Examiner*—Nicholas D. Lucchesi
*Assistant Examiner*—Tam Nguyen
(74) *Attorney, Agent, or Firm*—Troxell Law Office, PLC; Kuo-Hsiung Chiu

(57) ABSTRACT

The present invention relates to a rocker arm of a treadmill including a main frame, a running bed, a front support bar and a rear support bar. Moreover, an electronic console and two handles disposed on the main frame, while a running belt is wrapped around the running bed for an in-place rotation. In addition, the main frame has a set of rocker arms which can be grabbed by the user and swung back and forth. The set of rocker arms has the same relative structural design, each of which includes a base rotation bar and a rocking arm with a handgrip. Meanwhile, one end of the base rotation bar is hingedly attached to a pivot on the main frame, while the other end is pivotably attached to the end of the rocking arm. Furthermore, a spiral shape spring part is interposed between said base rotation bar and the bottom of said running bed, thereby providing said rocking arms with the necessary resistance.

2 Claims, 3 Drawing Sheets

ROCKER ARM OF A TREADMILL

BACKGROUND OF THE INVENTION

1. Fields of the Invention

The present invention relates to a rocker arm of a treadmill. This innovative invention is specially designed to adapt and move simultaneously with the natural swing of the users' hands as well as match the inclination changes of the running bed in order to provide more suitable resistance.

2. Description of the Prior Art

Most treadmills have a motor inside that can change the inclination of the running bed, thereby creating simulation conditions similar to running on flat ground and going uphill. For the runner, there is absolutely a distinct difference in the energy needed for running on flat ground and running uphill. Therefore, this invention is to improve my previously proposed patent, No. 09/994,454, the "Rocker Arm For An Electric Treadmill."On the previous patent, when the inclination of the running bed changes, the resistance cannot be simultaneously adjusted, therefore making it incapable of simulating real exercising conditions and creating a drawback in its design and usage.

SUMMARY OF THE INVENTION

Therefore, it is a primary object of the present invention to eliminate the above-mentioned drawbacks and to provide a rocker arm of a treadmill in which a spiral shape spring part is interposed between a base rotation bar and the bottom of a running bed so that the spiral shape spring part provides rocking arms with the necessary resistance. At the same time, the resistance provided by the spring part is positively correlated with the slope of the running bed, i.e. the steeper the slope, the greater the resistance and vise versa, which completely fulfills the actual running exercise conditions.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
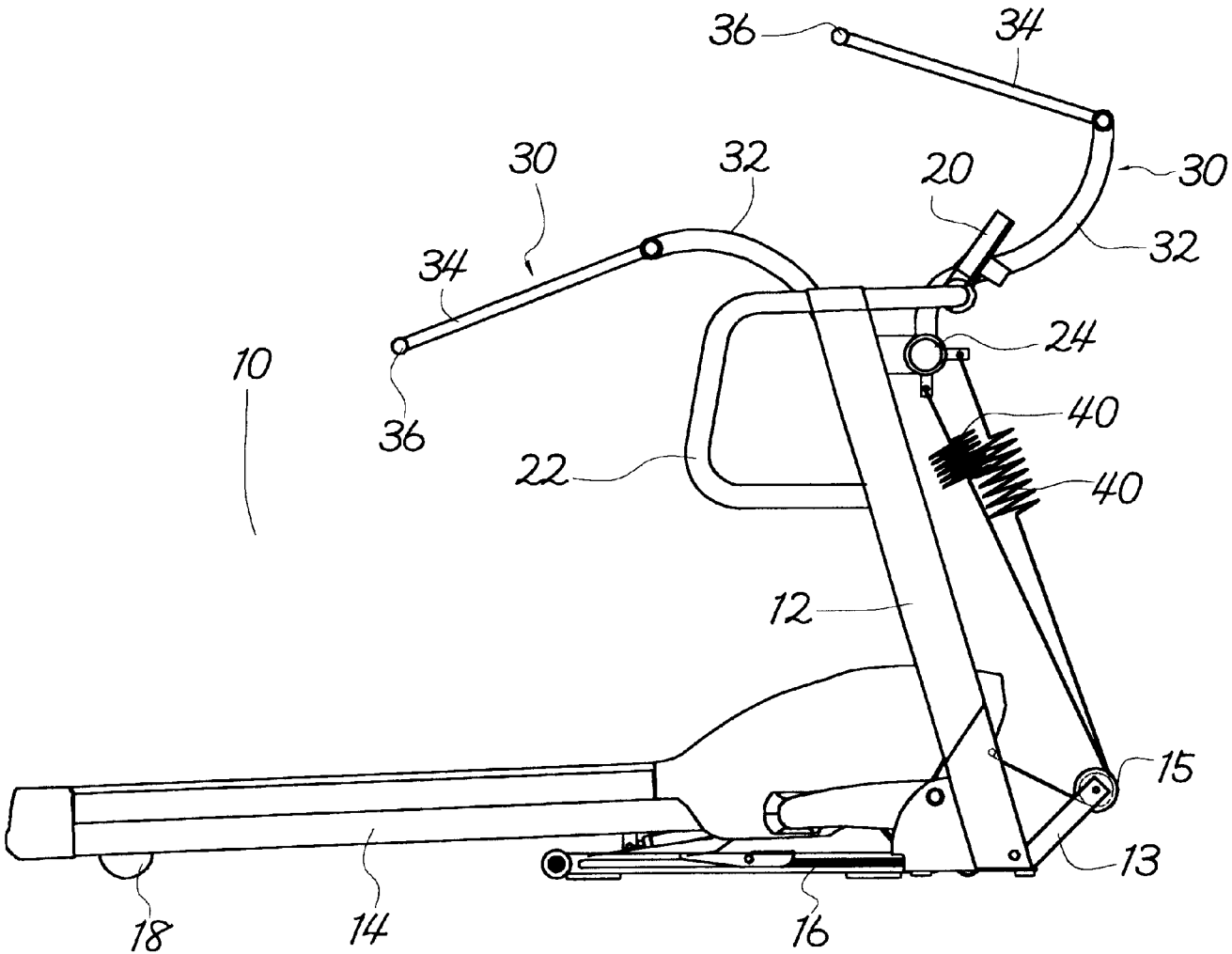
FIG. 1 is a side view of a preferred embodiment of the present invention.
Figure 2:
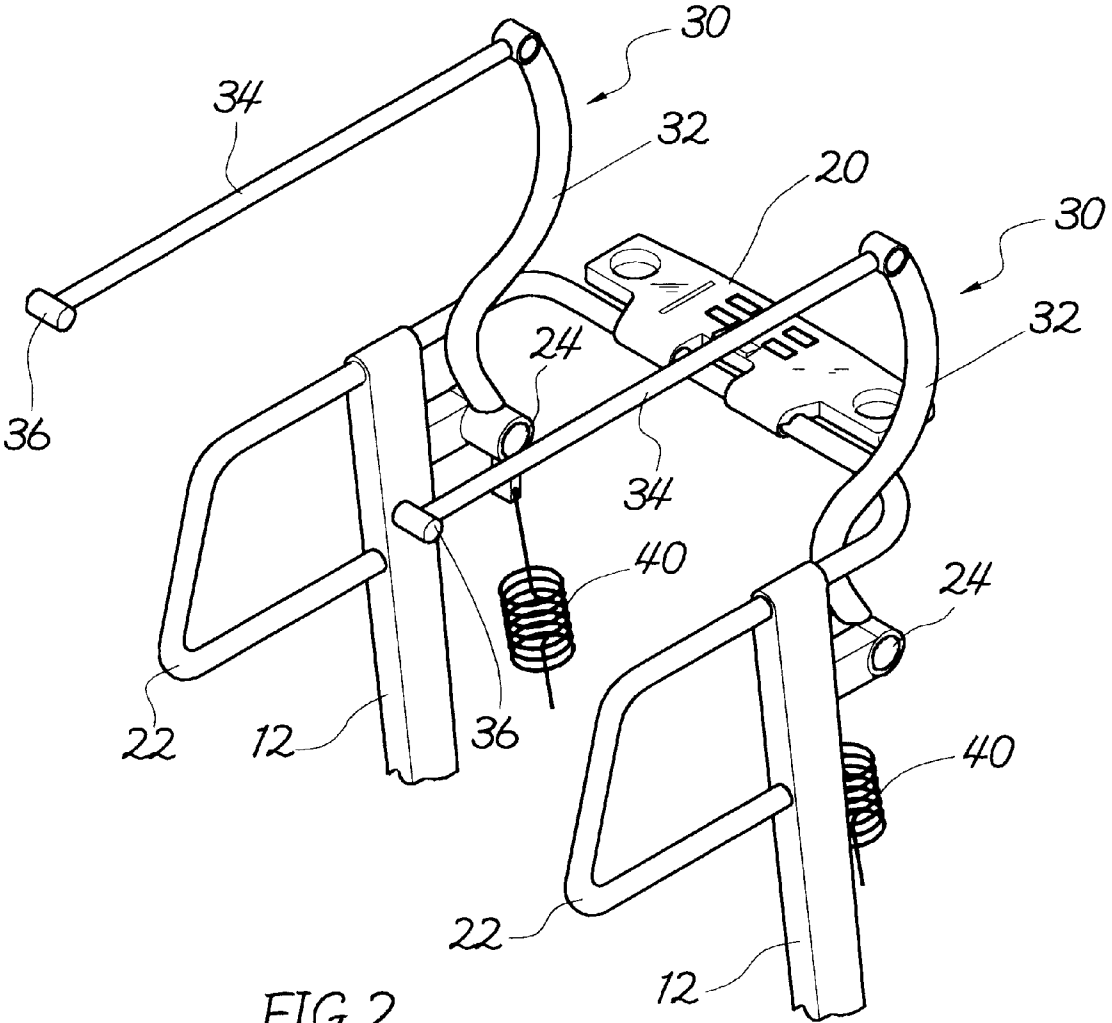
FIG. 2 is a perspective view of the preferred embodiment in accordance with FIG. 1.

First of all, referring to FIGS. 1 and 2, a preferred embodiment of the present invention fitted to the main frame of a treadmill is shown. From the Figure, the treadmill 10 is made up of basic components that include a main frame, a running bed, a front support bar and a rear support bar. Moreover, an electronic console 20 and two handles 22 are disposed on the main frame 12, while a running belt is wrapped around the running bed 14 not shown for an in-place rotation. In addition, the main frame has a set of rocker arms 30 which can be grabbed by the user and swung back and forth. The set of rocker arms 30 have the same relative structural design, each of which includes a base rotation bar 32 and a rocking arm 34 with a hand grip 36. Meanwhile, one end of the base rotation bar 32 is hingedly attached to a pivot 24 on the main frame 12, while the other end is pivotably attached to the end of the rocking arm.

Through the hinge attachment design between the base rotation bar 32 and the rocking arms 34, the set of rocker arms matches the natural movement of the user's arms, thereby achieving the expected goals of the user.

Figure 3:
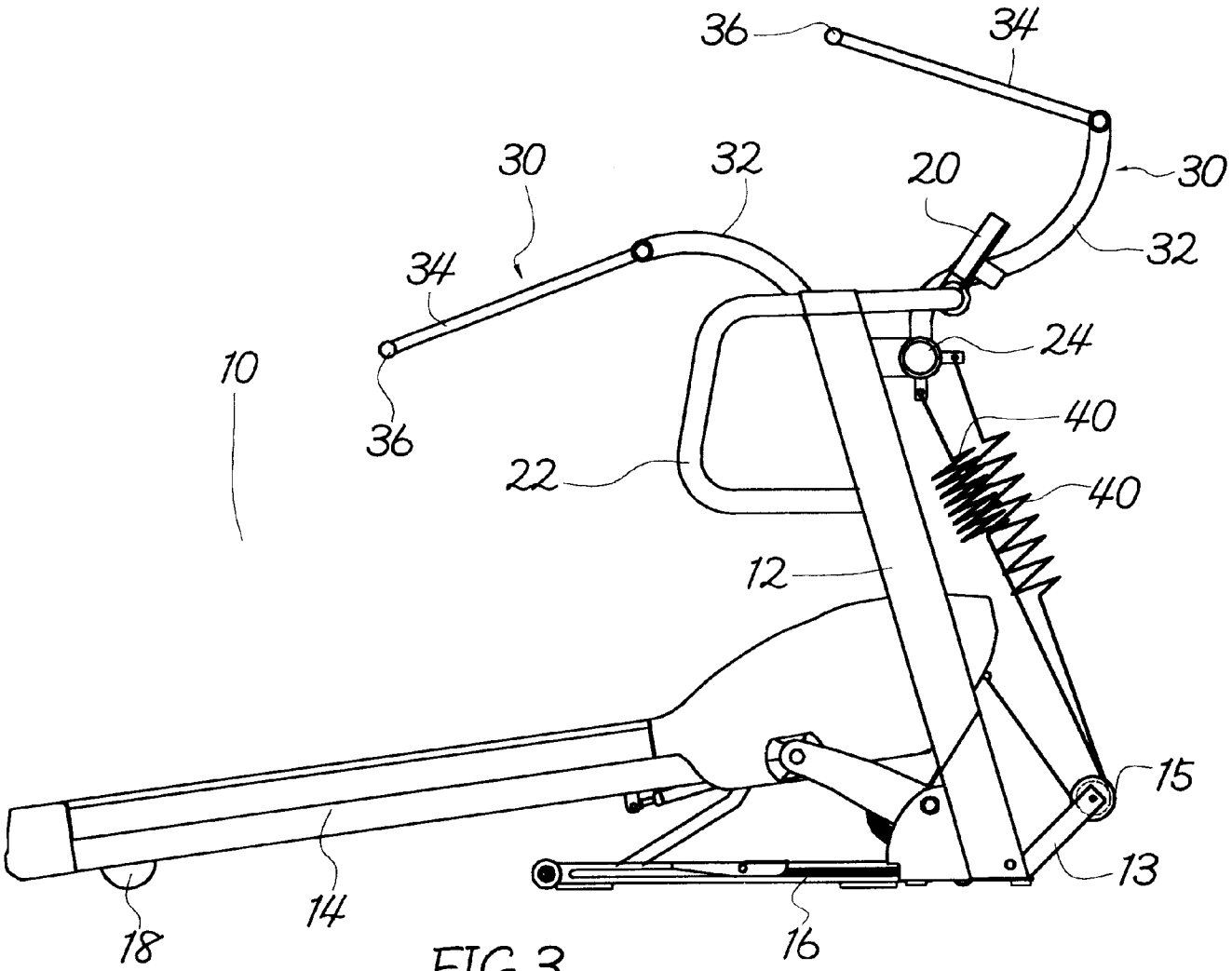
FIG. 3 is a side view of the preferred embodiment in accordance with FIG. 1, illustrating the slope of the running bed is adjusted.

In addition, a spiral shape spring part 40 is interposed between the base rotation bar 32 and the bottom of the running bed 40, thereby providing the rocking arms 34 with the necessary resistance. At the same time, as shown in FIG. 3, the resistance provided by the spring part 40 is positively correlated with the slope of the running bed 14, i.e. the steeper the slope, the greater the resistance the tenser the spring part 40 becomes and vise versa, which completely fulfills the actual running exercise conditions.

Furthermore, in order to effectively direct the positioning of the spring part 40 and prevent it from coming into contact and interfering with neighboring parts, an upward protruding part 13 with a positioning wheel is placed on the bottom of the main frame 12 to allow the spring part 40 to smoothly encircle it.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A rocker arm assembly of a treadmill with a main frame and a running bed comprising:

a) two rocker arms, each rocker arm having:
   i) a base rotation bar pivotally connected at a first end to the main frame of the treadmill;
   ii) a rocking arm pivotally connected at a first end to a second end of the base rotation bar; and
   iii) a hand grip on a second end of the rocking arm; and b) two spiral springs providing a resistance to the two rocker arms, each spiral spring connected at opposing ends thereof to one of the two rocker arms and to the running bed of the treadmill.

2. The rocker arm according to claim 1, wherein each spiral spring provides a resistance that positively correlates with a slope of the running bed.

* * * * *